US006071147A

United States Patent [19]

Tsukamoto

[11] Patent Number: 6,071,147

[45] Date of Patent: Jun. 6, 2000

[54] WATERPROOF CONNECTOR

[75] Inventor: Hisashi Tsukamoto, Shizuoka, Japan

[73] Assignee: Yazak Corporation, Tokyo, Japan

[21] Appl. No.: 09/037,004

[22] Filed: Mar. 9, 1998

[30] Foreign Application Priority Data

Mar. 10, 1997 [JP] Japan ..... 9-054740

[51] Int. Cl.[7] ..... H01R 13/40

[52] U.S. Cl. ..... 439/587; 439/275

[58] Field of Search ..... 439/587, 275, 439/274, 588, 589, 279, 595; 277/209, 210

[56] References Cited

U.S. PATENT DOCUMENTS 5,482,299 1/1996 Saito ..... 277/209

5,857,864 1/1999 Fukuda ..... 439/275

*Primary Examiner*—Neil Abrams

*Assistant Examiner*—Chandrika Prasad

*Attorney, Agent, or Firm*—Armstrong, Westerman, Hattori, McLeland & Naughton

[57] ABSTRACT

An improved waterproof connector is provided. In this waterproof connector, circular expanded portions for sealing are formed on the outer periphery of the waterproof packing having insertion holes. The circular expanded portions each has a diameter greater than the diameter of the inner circular surface of the waterproof packing receiving chamber of the connector housing. In the temporary engagement of the waterproof packing with the connector housing, the waterproof packing is situated outside the waterproof packing receiving chamber, and the circular expanded portions are not pressed. Thus, terminal metal fitting and wires can pass through the insertion holes of the waterproof packing without damaging them.

4 Claims, 3 Drawing Sheets

WATERPROOF CONNECTOR

BACKGROUND OF THE INVENTION

1. Field of the Invention

The present invention relates to a waterproof connector used in connecting a wire harness for vehicles.

2. Related Art

In FIGS. 4 and 5, a wire introducing portion b is provided at the rear of a terminal receiving chamber $a_1$ of a connector housing a. An elastic waterproof packing c having a plurality of wire insertion holes $c_1$ is inserted into the wire introducing portion b, followed by a pressing member d having a plurality of wire insertion holes $d_1$. A cam member e is inserted into the wire introducing portion b from one of its outer side surface, and crosses the inside of the wire introducing portion b so as to be engaged with the pressing member d. Here, the cam member e presses the pressing portion d in the vertical direction. By this pressing force, the waterproof packing c is pressed to the waterproof packing contact surface b1 of the wire introducing portion b and the outer surfaces of wires f. A terminal metal fitting g is connected to each of the wires f.

FIG. 5A illustrates the temporary engagement state of the pressing member d with the connector housing a. In this condition, the terminal fittings g and the wires f are inserted into the terminal receiving chamber $a_1$ through the wire insertion holes $c_1$ of the elastic waterproof packing c. The pressing member d is then pushed and moved further to its permanent engagement position, thereby pressing the elastic waterproof packing c as shown in FIG. 5B.

In the pressed stage, as shown in FIG. 6, portions $c_2$ and $c_3$ of the pressed elastic waterproof packing c are deformed by the support wall a2 of the connector housing a and the pressing wall of the pressing member d. In view of this, to press the waterproof packing contact surface b1 of the wire introducing portion b and the outer surfaces of the wires f, it is necessary to exert large pressing forces on the elastic waterproof packing c.

SUMMARY OF THE INVENTION

The principal object of the present invention is to provide a waterproof connector which exhibits excellent waterproof properties by deforming the waterproof packing with a relatively small pressing force.

The waterproof connector of the present invention consists of a connector housing having a waterproof packing receiving chamber, and a waterproof packing to be engaged with the connector housing by a two-stage process including a temporary engagement stage and a permanent engagement stage. Inner circular expanded portions for sealing are formed in the insertion holes inside the waterproof packing, while outer circular expanded portions for sealing are formed on the outer periphery of the waterproof packing. In the temporary engagement stage, the outer circular expanded portions, having a diameter greater than the diameter of the inner circular surface of the waterproof packing receiving chamber of the connector housing, are situated outside the waterproof packing receiving chamber. In the permanent engagement stage, the outer circular expanded portions are pressed by the inner circular surface of the waterproof packing receiving chamber. A circular engagement guide portion having a diameter smaller than the diameter of the inner circular surface of the waterproof packing receiving chamber is formed in front of the outer circular expanded portions. In the temporary engagement stage, the circular engagement guide portion is situated inside the waterproof packing receiving chamber.

Since the outer circular expanded portions formed on the outer periphery of the waterproof packing are not pressed in the temporary engagement stage, terminal metal fittings and wires can readily pass through the insertions holes in the waterproof packing without damaging them. Thus, the life of the waterproof packing can be dramatically prolonged.

Since the circular engagement guide portion in the front of the waterproof packing is situated in the waterproof packing receiving chamber of the connector housing in the temporary engagement stage, the waterproof packing can smoothly shift to the permanent engagement stage.

The above and other objects and features of the present invention will be more apparent from the following description taken in conjunction with the accompanying drawings.

BRIEF DESCRITION OF THE DRAWINGS

DETAILED DESCRIPTION OF THE PREFERRED EMBODIMENTS

The following is a description of embodiments of the present invention with reference to the accompanying drawings.

Figure 1:
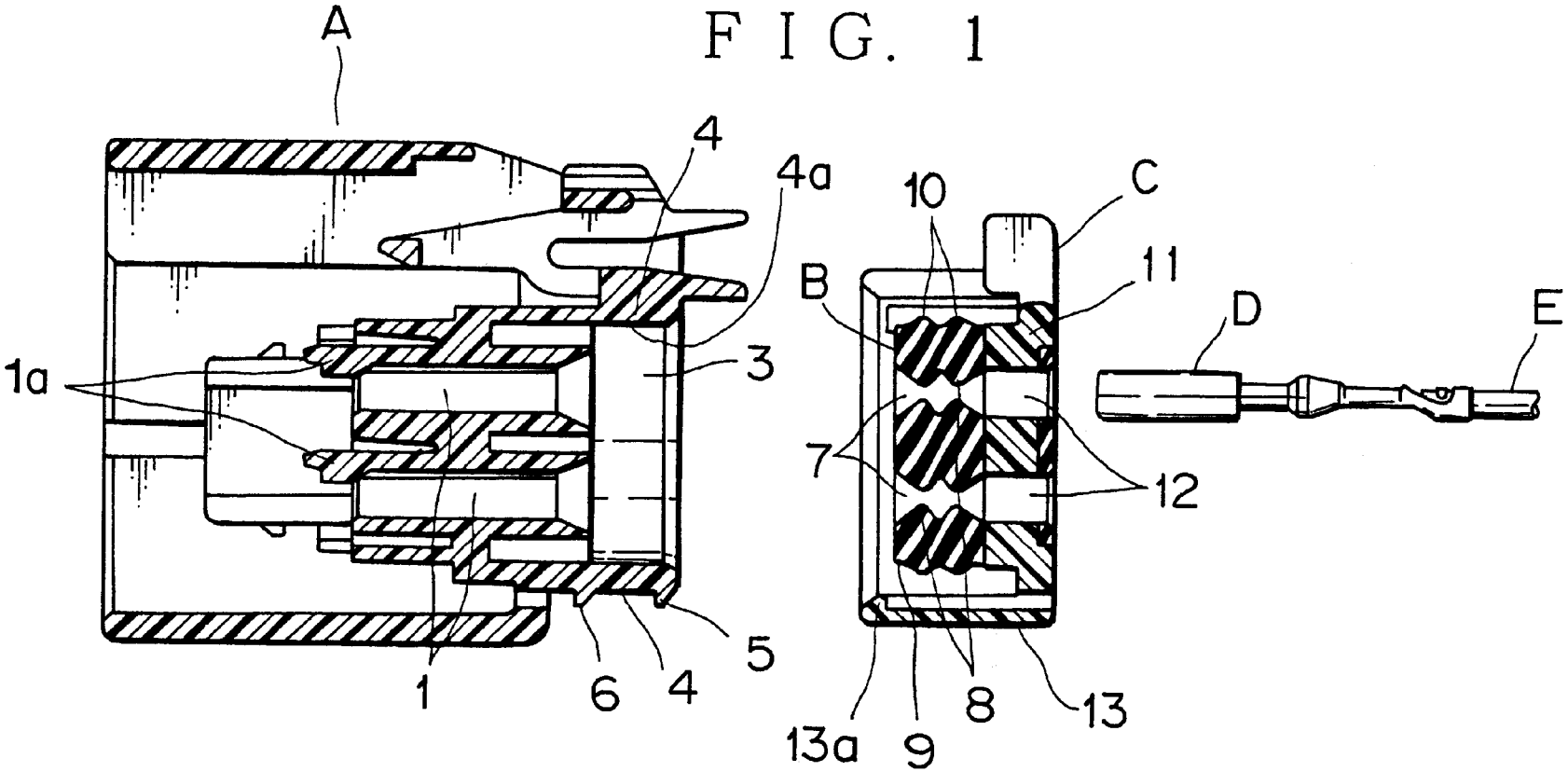
FIG. 1 is an exploded sectional view of one embodiment of the present invention.
Figure 2:
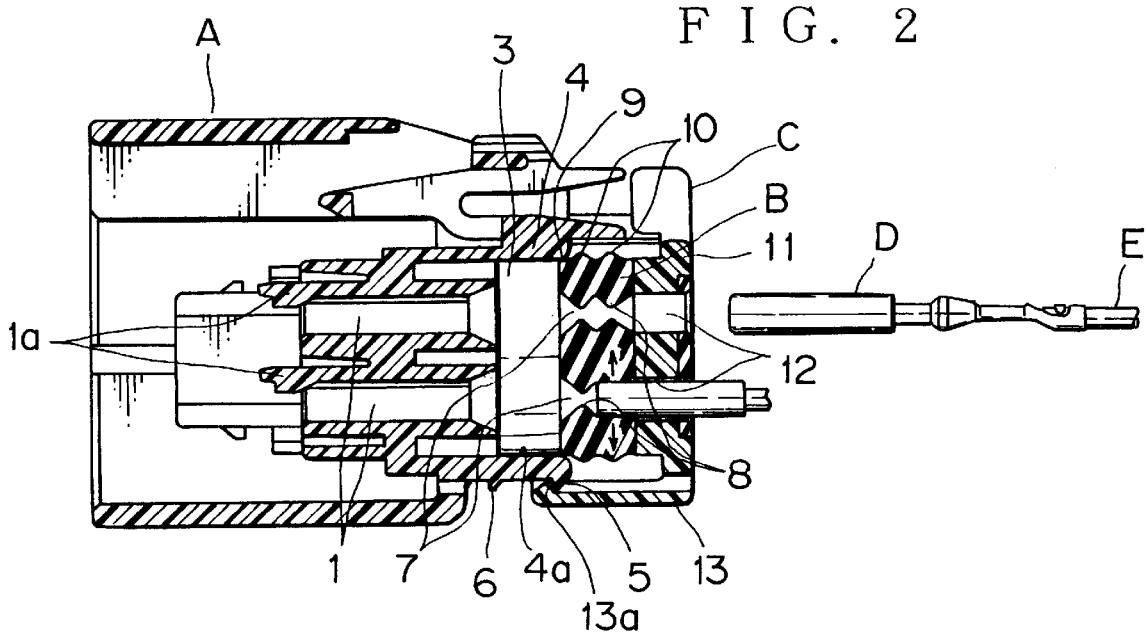
FIG. 2 is a sectional view illustrating how the waterproof packing and the connector housing of the embodiment shown in FIG. 1 are engaged in the temporary engagement stage.
Figure 3:
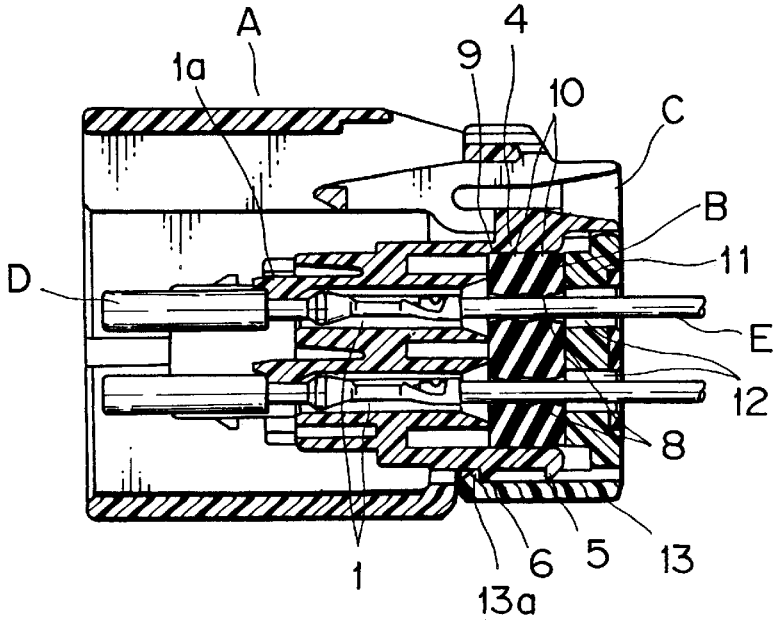
FIG. 3 is a sectional view illustrating how the waterproof packing and the connector housing of the embodiment shown in FIG. 1 are engaged in the permanent engagement stage.
Figure 4:
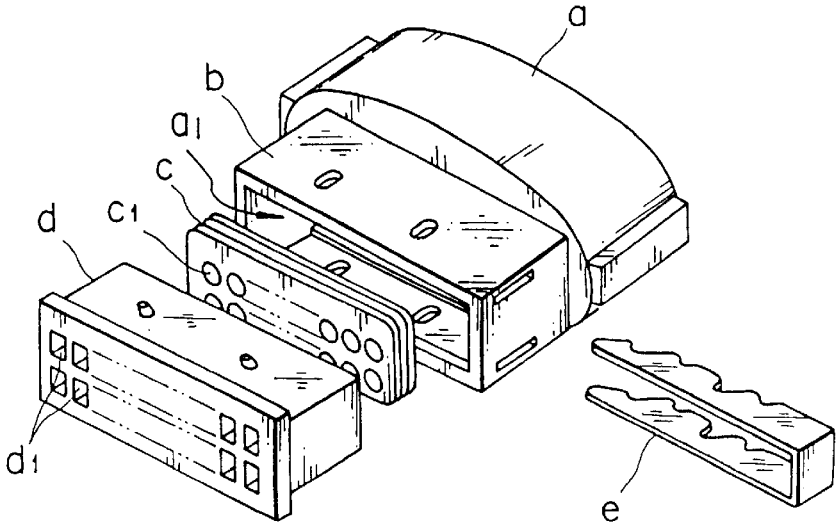
FIG. 4 PRIOR ART
FIG. 4 is an exploded perspective view of the prior art.
Figure 5A:
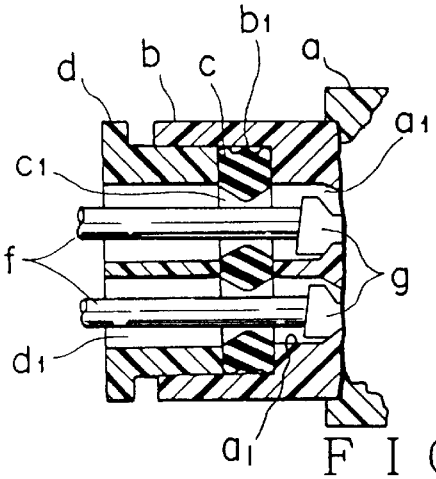
FIG. 5A PRIOR ART
FIG. 5A is a schematic sectional view illustrating how the waterproof connector of the prior art is temporarily engaged.
Figure 5B:
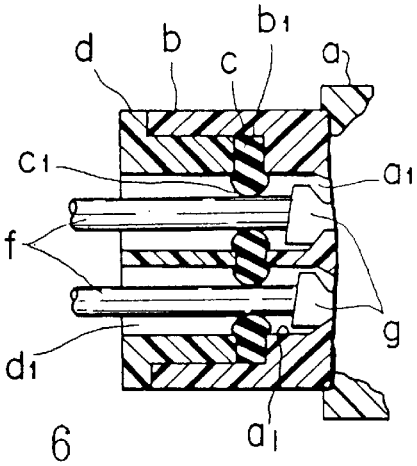
FIG. 5B PRIOR ART
FIG. 5B is a schematic sectional view illustrating how the waterproof connector of the prior art is permanently engaged.
Figure 6:
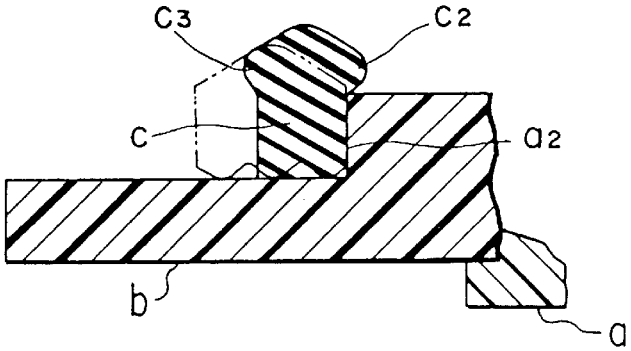
FIG. 6 PRIOR ART
FIG. 6 is an enlarged sectional view of the waterproof stopper used in the waterproof connector of FIG. 5B.

FIGS. 1 to 3 show a connector housing A made of a synthetic resin, a waterproof packing B made of an elastic material such as elastomer, a waterproof stopper cover C made of a synthetic resin, a terminal metal fitting D, and a wire E.

In the connector housing A, a plurality of terminal receiving chambers 1 each having a flexible stopper member 1*a* are formed. A waterproof packing receiving chamber 3 is formed at the rear of the terminal receiving chambers 1. A temporary stopper protrusion 5 and a permanent stopper protrusion 6 protrude from the outer surface of the circular wall of the waterproof packing receiving chamber 3.

A plurality of insertion holes 7 corresponding to the terminal receiving chambers 1 are formed in the waterproof packing B, and circular expanded portions 8 for sealing are formed inside the insertion holes 7. On the outer periphery of the waterproof packing B, large circular expanded portions 10 for sealing are formed. The large circular expanded portions 10 each have a diameter greater than the diameter of a small circular engagement guide portion 9 at the front of the waterproof packing B.

The base plate member 11 of the waterproof packing cover C has insertion holes 12 corresponding to the insertion holes 7. The waterproof packing B and the cover C are integrally formed, with the insertion holes 7 communicating with the insertion holes 12. A flexible stopper arm 13 is provided on the outer periphery of the base plate member 11. In FIG. 2, the waterproof packing B and the cover C are temporarily engaged with the connector housing A, with the stopper 13*a* of the flexible stopper arm 13 being engaged with the temporary stopper protrusion 5. In such temporary engagement state, the circular engagement guide portion 9 of a diameter smaller than the diameter of a circle formed by the inner circular surface 4*a* of the circular wall 4 of the waterproof packing receiving chamber 3 is overlapped on the inner circular surface 4*a* inside the waterproof packing receiving chamber 3, whereas the large circular expanded portions 10 for sealing are situated outside the waterproof packing receiving chamber 3.

In the temporary engagement state, the terminal metal fitting D and the wire E, which are connected to each other in advance, are inserted into one of the insertion holes 12, and the terminal metal fitting D then penetrates through the corresponding insertion hole 7 until it is stopped by the corresponding flexible stopper member 1*a*. Since the circular expanded portions 10 of the waterproof packing B are not in a pressed state at this point, the circular expanded portions 8 situated inside the insertion holes 7 each having a diameter smaller than the diameter of the terminal metal fitting D and the diameter of the wire E can readily contract and shift. Thus, the terminal metal fitting D can pass through the insertion holes 7 without damaging the circular expanded portions 8.

The cover C is pushed so as to force the waterproof packing B into the waterproof packing receiving chamber 3. In such situation, the circular expanded portions 10 are pressed by the inner circular surface 4*a* of the circular wall 4, and brought into contact with the inner circular surface 4*a*. This pressing force onto the circular expanded portions 10 reaches the circular expanded portions 8 inside the insertion holes 7, thereby improving the sealing performance of the circular expanded portions 8.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A waterproof connector comprising:

a connector housing having a waterproof packing receiving chamber;

a waterproof packing to be connected to the connector housing by a two-stage engagement process including a temporary engagement stage and a permanent engagement stage;

insertion holes formed in the waterproof packing;

inner circular expanded portions for sealing formed inside the insertion holes; and outer circular expanded portions for sealing formed on the outer periphery of the waterproof packing, wherein the waterproof packing has a waterproof packing cover covering the whole thereof, a flexible stopper arm is formed on the outer periphery of a base plate member of the waterproof packing cover, the waterproof packing receiving chamber is provided with a temporary stopper protrusion and a permanent stopper protrusion on the outer surface thereof, the outer circular expanded portions have a diameter greater than the diameter of the inner circular surface of the waterproof packing receiving chamber of the connector housing and are situated outside the waterproof packing receiving chamber in the temporary engagement stage, and the outer circular expanded portions are pressed by the inner circular surface of the waterproof packing receiving chamber in the permanent engagement stage.

2. The waterproof connector according to claim 1, wherein the waterproof packing cover has insertion holes formed in the base plate member, and the waterproof packing and the waterproof packing cover are integrally formed, with the insertion holes of the waterproof packing cover communicating with the insertion holes of the waterproof packing.

3. The waterproof connector according to claim 2, wherein the flexible temporary stopper arm on the outer periphery of the base plate member is engaged with the temporary stopper protrusion in the temporary engagement stage, so that terminal metal fittings can pass through the waterproof packing without damaging the inner circular expanded portions for sealing.

4. A waterproof connector comprising:

a connector housing having a waterproof packing receiving chamber;

a waterproof packing to be connected to the connector housing by a two-stage engagement process including a temporary engagement stage and a permanent engagement stage;

insertion holes formed in the waterproof packing;

inner circular expanded portions for sealing formed inside the insertion holes; and outer circular expanded portions for sealing formed on the outer periphery of the waterproof packing, wherein a circular engagement guide portion having a diameter smaller than the diameter of the inner circular surface of the waterproof packing receiving chamber is formed in front of the outer circular expanded portions for sealing, such that in the temporary engagement stage, the circular engagement guide portion is situated inside the waterproof packing receiving chamber, the outer circular expanded portions have a diameter greater than the diameter of the inner circular surface of the waterproof packing receiving chamber of the connector housing and are situated outside the waterproof packing receiving chamber in the temporary engagement stage, and the outer circular expanded portions are pressed by the inner circular surface of the waterproof packing receiving chamber in the permanent engagement stage.

* * * * *

UNITED STATES PATENT AND TRADEMARK OFFICE

CERTIFICATE OF CORRECTION

PATENT NO.: 6,071,147
DATED : June 6, 2000
INVENTOR(S): Tsukamoto

It is certified that error appears in the above-identified patent and that said Letters Patent is hereby corrected as shown below:

Title page, item
[73] change from "Yazak Corporation" to --YAZAKI CORPORATION--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*